US007451545B2

(12) United States Patent
Vörös

(10) Patent No.: US 7,451,545 B2
(45) Date of Patent: Nov. 18, 2008

(54) HAND KNIFE

(75) Inventor: Robert Vörös, Pocking (DE)

(73) Assignee: Heinr, Boker Baumwerk GmbH (DE)

( * ) Notice: Subject to any disclaimer, the term of this patent is extended or adjusted under 35 U.S.C. 154(b) by 310 days.

(21) Appl. No.: 11/311,840

(22) Filed: Dec. 19, 2005

(65) Prior Publication Data

US 2006/0130337 A1 Jun. 22, 2006

(30) Foreign Application Priority Data

Dec. 21, 2004 (DE) ..... 10 2004 062 783

(51) Int. Cl.
*B26B 3/06* (2006.01)

(52) U.S. Cl. ..... 30/153; 30/155

(58) Field of Classification Search ..... 30/153, 30/155, 160, 161, 156, 158, 159; 224/268, 224/269, 901.2, 901.4, 901.6, 930
See application file for complete search history.

(56) References Cited

U.S. PATENT DOCUMENTS

| | | | | | |
|---|---|---|---|---|---|
| 1,828,121 | A | * | 10/1931 | Adam et al. | 30/155 |
| 2,250,290 | A | * | 7/1941 | Berg | 30/160 |
| 2,263,415 | A | * | 11/1941 | Berg et al. | 30/160 |
| 2,839,831 | A | * | 6/1958 | Baer | 30/155 |
| 4,606,123 | A | * | 8/1986 | Wrench | 30/153 |
| 4,612,706 | A | * | 9/1986 | Yunes | 30/160 |
| 4,646,440 | A | | 3/1987 | Decker | |
| 4,773,159 | A | | 9/1988 | Casazza, Jr. | |
| 4,947,552 | A | * | 8/1990 | Barnes | 30/161 |
| 4,974,323 | A | * | 12/1990 | Cassady | 30/160 |
| 5,029,354 | A | * | 7/1991 | Boyd, Jr. et al. | 30/161 |
| 5,572,793 | A | * | 11/1996 | Collins et al. | 30/155 |
| 5,581,834 | A | * | 12/1996 | Collins | 30/155 |
| 5,628,117 | A | * | 5/1997 | Glesser | 30/155 |
| 6,594,906 | B1 | * | 7/2003 | Sakai et al. | 30/155 |
| 6,675,484 | B2 | * | 1/2004 | McHenry et al. | 30/161 |
| 6,941,604 | B2 | * | 9/2005 | Ackeret | 7/160 |
| 7,000,323 | B1 | * | 2/2006 | Hatcher et al. | 30/155 |
| D520,843 | S | * | 5/2006 | Voros | D8/99 |
| 7,051,440 | B2 | * | 5/2006 | Bremicker et al. | 30/161 |
| 7,062,857 | B1 | * | 6/2006 | Nenadic | 30/161 |
| 2004/0129746 | A1 | * | 7/2004 | Lee et al. | 224/271 |
| 2006/0113985 | A1 | * | 6/2006 | Gist et al. | 224/930 |
| 2006/0277762 | A1 | * | 12/2006 | Knight et al. | 30/153 |
| 2007/0289141 | A1 | * | 12/2007 | Caswell | 30/160 |

FOREIGN PATENT DOCUMENTS

| | | | |
|---|---|---|---|
| DE | 3046093 | C2 | 2/1986 |
| DE | 102 46 079 | | 4/2003 |
| FR | 1 291 438 | | 3/1962 |
| FR | 2609923 | A1 * | 7/1988 |
| JP | 2003-53058 | | 2/2003 |

* cited by examiner

*Primary Examiner*—Jason D. Prone
(74) *Attorney, Agent, or Firm*—Harness, Dickey & Pierce, P.L.C.

(57) ABSTRACT

A hand knife has a handle (1), a blade (2), and a fixing clip (3). The blade is adjustable between a closed position and an open position relative to the handle (1). The fixing clip (3) is adjustable between a withdrawn position and a projecting position relative to the handle (1). An adjusting assembly (10) adjusts the fixing clip (3) from the projecting position into the withdrawn position by adjusting the blade (2) from the closed position into the open position.

14 Claims, 4 Drawing Sheets

BOKER

BÖKER

HAND KNIFE

CROSS-REFERENCE TO RELATED APPLICATION

This application claims priority to German Patent Application No. 102004062783.5, filed Dec. 21, 2004, which application is herein expressly incorporated by reference.

FIELD

The disclosure relates to a hand knife, such as a jack knife, which includes an adjustable blade and a fixing clip to fix the hand knife to a belt, or the like.

BACKGROUND

A problem with hand knives with a fixing clip is that, when using the knife, the fixing clip is in the way. This adversely affects the hold on the knife as well as the haptics in a person's hand.

U.S. Pat. No. 4,773,159 shows a hand knife with a handle and a blade. The blade, relative to the handle, is adjustable between a closed position and an open position. Furthermore, two fixing clips are provided to attach the hand knife to a belt, or the like.

The knife has a central housing portion fixed to the blade of the knife. Two handle cups are provided, at a distance, on both sides of the central housing portion. Each handle cup forms a slot together with the central housing portion. Spring arms are provided inside the slots to form the clip to make it possible for the hand knife to be clipped to a belt. Thus, the entire handle, consisting of the central housing portion and the two handle cups, forms two slots for the fixing clips.

JP 2003-53058 proposes a jack knife where the blade is foldable around a pivot axis which extends in the direction of the blade plane. The blade is provided with two handle portions. In the closed position of the blade, the blade is accommodated between the handle portions, which are arranged on one side of the blade. In the closed blade position, a fixing clip is provided on the outer side of one of the handle portions. Thus, the fixing clip is accessible from the outside. In the open position of the blade, the two handle portions form the handle of the jack knife. The fixing clip is accommodated between the two handle portions without an interfering effect when the knife is handled.

DE 102 46 079 A1 describes a hand knife with an adjustable blade and a fixing clip. The fixing clip is ergonomically formed and, on its outside, copies the shape of the handle cups. Thus, this achieves the least possible interference when the knife is handled.

The statements in this section merely provide background information related to the present disclosure and may not constitute prior art.

SUMMARY

According to the present teachings, a hand knife includes an adjustable blade and a fixing clip. The fixing clip, in the open position of the blade, does not have an adverse effect on the handling of the knife.

A hand knife comprises a handle and a blade which, relative to the handle, is adjustable between a closed position and an open position. A fixing clip, relative to the handle, is adjustable between a withdrawn position and a projecting position. An adjusting assembly, when the blade is adjusted from the closed position into the open position, adjusts the fixing clip from the projecting position into the withdrawn position.

The fixing clip is adjustable relative to the handle. The fixing clip can assume a projecting position where the hand knife can be fixed to a belt. In a withdrawn position, the fixing clip does not interferingly project from the handle. In the withdrawn position, the fixing clip can be fully countersunk into the surface of the handle, so that the outer surface of the clip is flush with the outer surface of the handle, or withdrawn on top of the surface of the handle. Furthermore, the position of the fixing clip is coupled to the movement of the blade. Thus, in the open position of the blade, the fixing clip is in the withdrawn position. Also, in the closed position of the blade, the fixing clip is in the projecting position. The blade can, for instance, be arranged to be pivotable or displaceable relative to the handle.

A coupling mechanism is provided between the blade and the fixing clip in the form of an adjusting assembly. The adjusting element comprises an actuating portion and an adjustable portion. The actuating portion cooperates with the blade and the adjustable portion cooperates with the fixing clip.

The adjustable portion can be adjusted by the blade, which acts on the actuating portion of the adjustable portion, between a first position, where the fixing clip assumes the withdrawn position, and a second position, where the fixing clip assumes the projecting position.

The blade is fixed at the handle to be pivotable around a pivot axis. The adjusting element can be provided in the form of a pivot lever. The pivot lever is pivotable transversely to the pivot axis between the first position and the second position. The actuating portion comprises a setting contour. The setting contour cooperates with an actuating projection which eccentrically projects from the blade relative to the pivot axis. The adjustable portion is provided at the pivot lever end remote from the actuating portion. The fixing clip is displaceably guided on the handle.

The blade can be fixed to pivot around a pivot axis. The adjusting element is eccentrically supported relative to the pivot axis against the blade and transversely relative to the pivot axis. By pivoting the blade, the adjustable portion is displaced transversely to the pivot axis. The adjustable portion is supported against the fixing clip. The fixing clip is guided at an angle relative to the setting axis of the adjustable portion.

The adjusting element can be provided in the form of a setting slide. The setting slide is guided transversely to the pivot axis along a setting axis. The blade comprises a setting contour which eccentrically extends around the pivot axis. The setting slide is supported against the setting contour. Furthermore, the setting slide is supported against the fixing clip. The fixing clip is guided in the handle along an adjustment axis. The adjustment axis encloses an acute angle relative to the setting axis of the setting slide. Axial movement of the setting slide enables a movement component of the fixing clip transverse to the setting axis. The adjustment axis of the fixing clip extends at an acute angle and thus acts like a ramp.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figures 1, 2, 3:
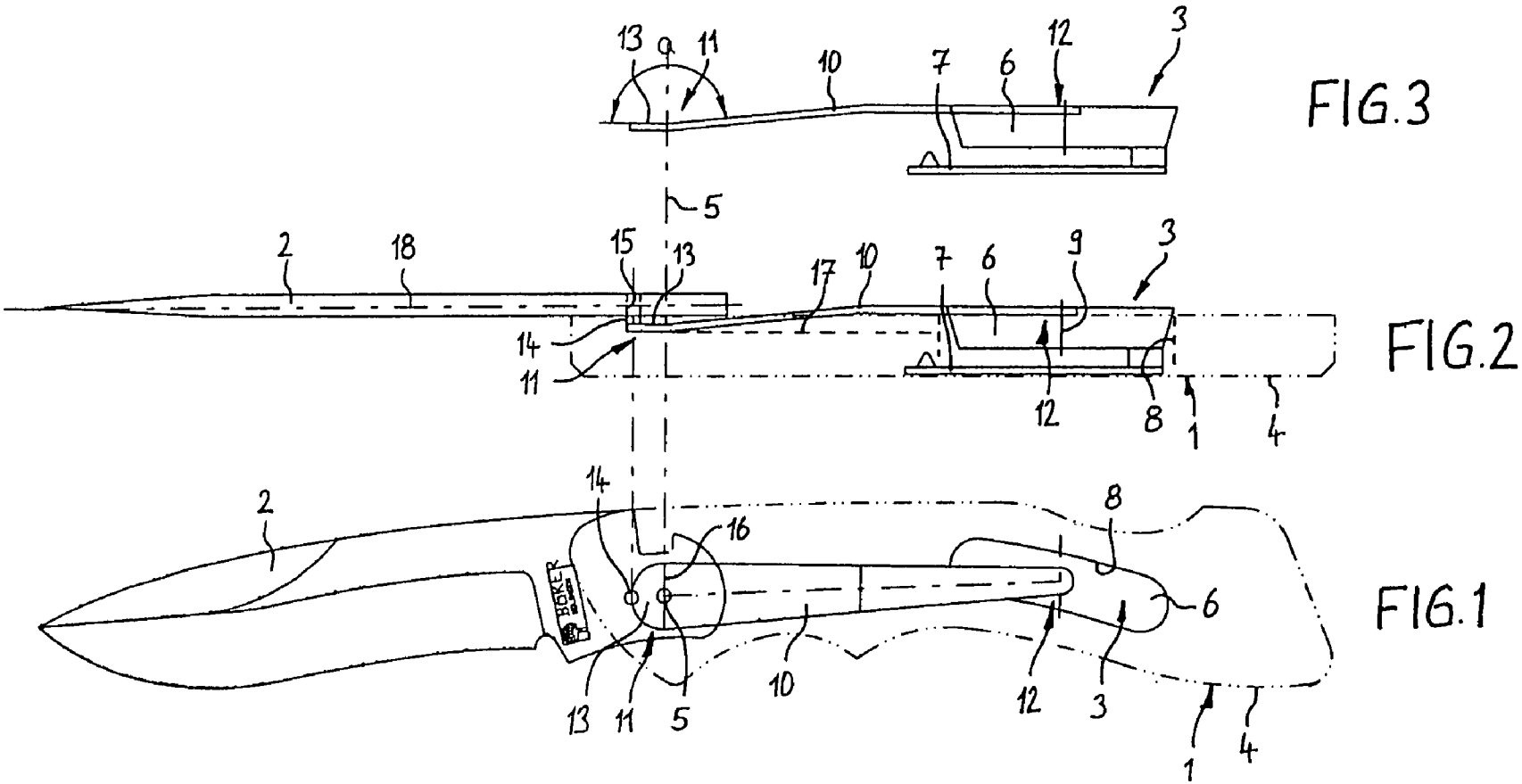
FIG. 1 is an elevation view of a hand knife in an open position.
FIG. 2 is a side elevation view of the hand knife according to FIG. 1.
FIG. 3 is a side elevation view of an adjusting assembly according to FIG. 2.

The following description is merely exemplary in nature and is not intended to limit the present disclosure, application, or uses.

FIGS. 1 to 6 show a first embodiment of a hand knife and will be described jointly below.

The hand knife comprises a handle 1, a blade 2 as well as a fixing clip 3. The handle 1 has two handle cups of which, for the sake of clarity, only one handle cup 4 is shown. The blade 2 is connected to the handle 1 to be pivotable around a pivot axis 5 between the open position, shown in FIGS. 1 and 2, and the closed position illustrated, in FIGS. 4 and 5.

Figures 4, 5, 6:
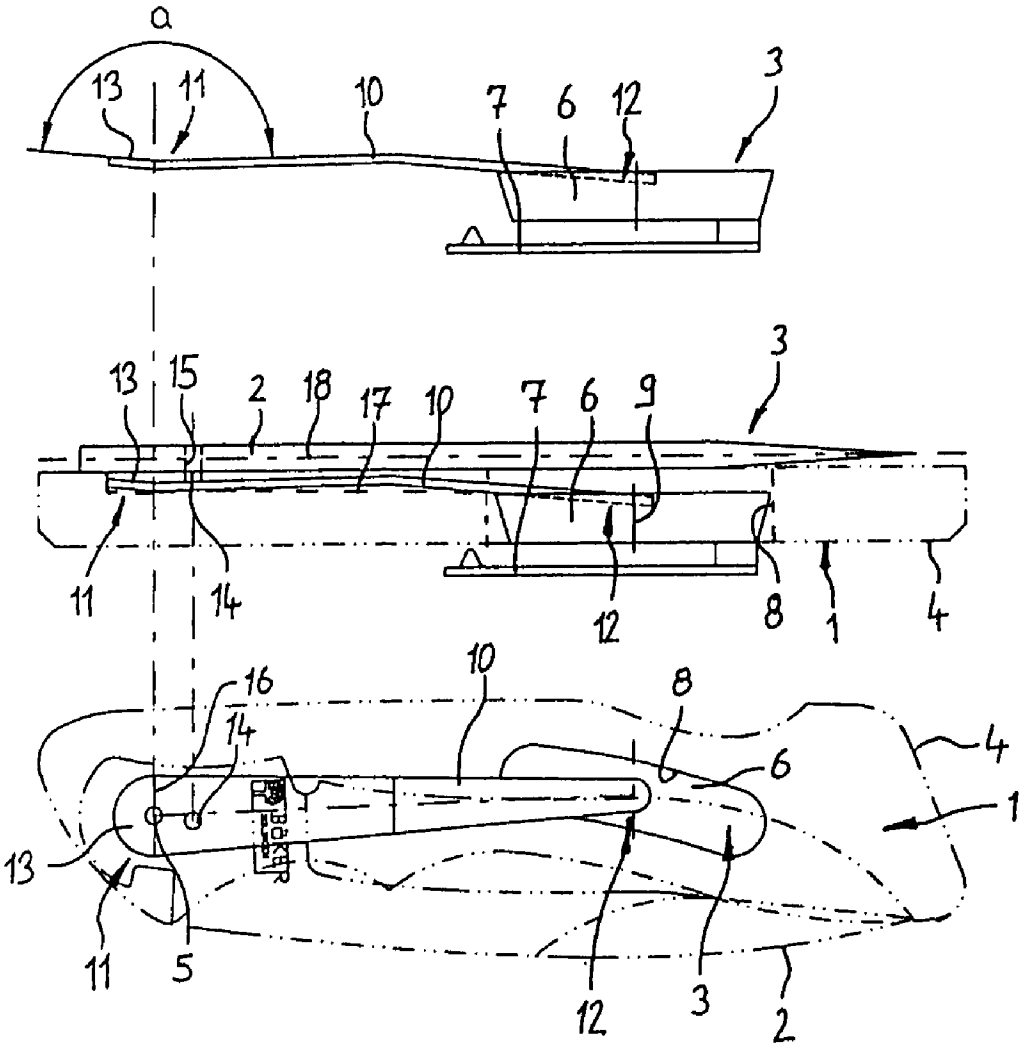
FIG. 4 is an elevation view of the hand knife according to FIG. 1 in a closed position.
FIG. 5 is a side elevation view of the hand knife according to FIG. 4.
FIG. 6 is a side elevation view of the adjusting assembly according to FIG. 5.
Figure 7:
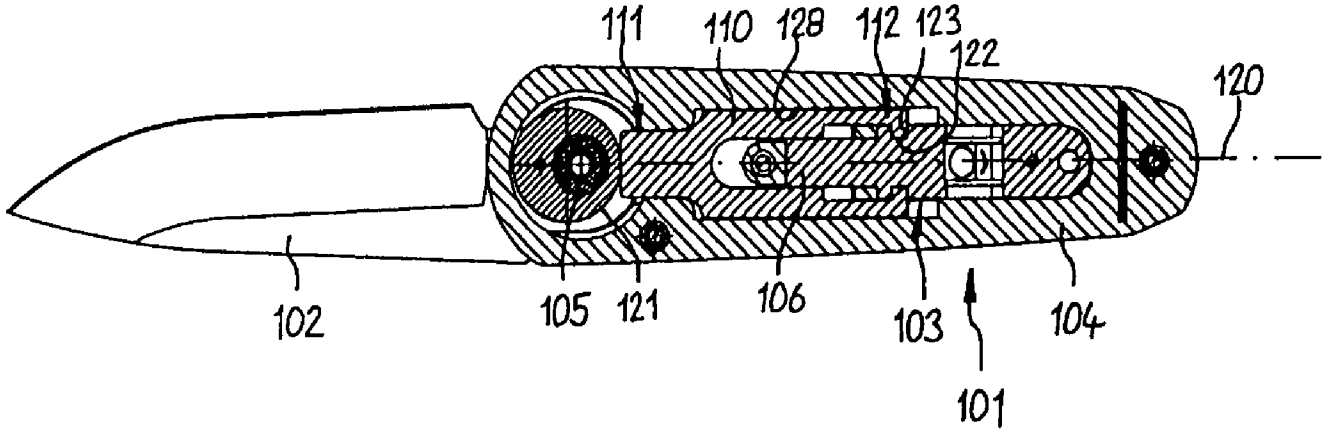
FIG. 7 is a plan view, partially in section, of a second embodiment of the knife with the blade shown in the open position.
Figure 8:
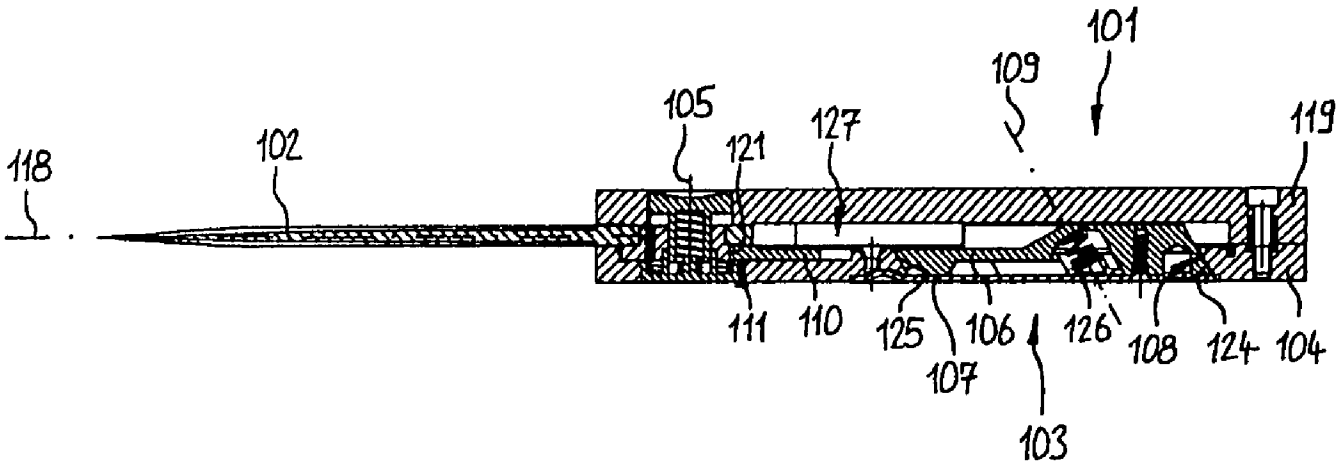
FIG. 8 is a longitudinal section view through the knife according to FIG. 7.
Figure 9:
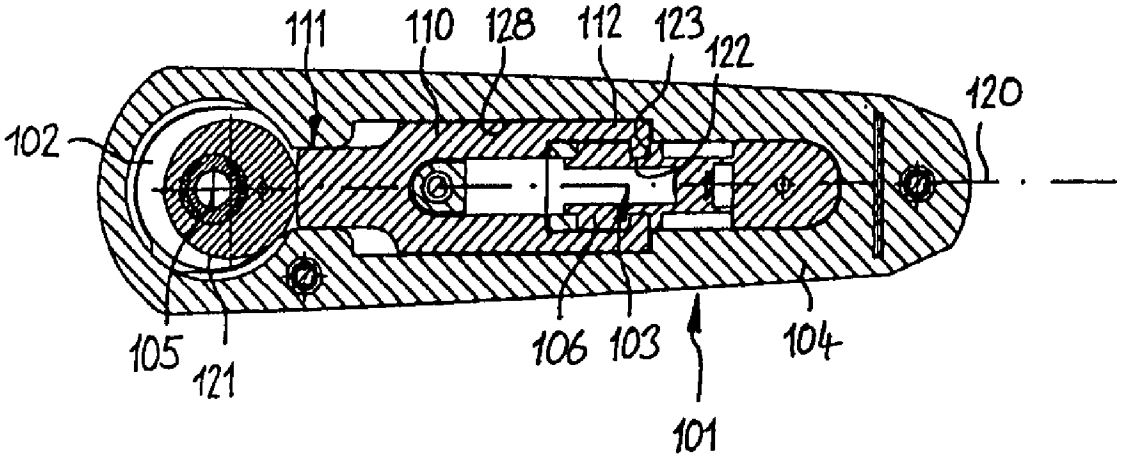
FIG. 9 is a plan view, partially in section, of the hand knife according to FIG. 7 with the blade in the closed position.

The fixing clip 3 includes a guiding plate 6 as well as a spring arm 7. The fixing clip 3 is displaceably guided in a recess 8 of the handle cup 4 along an adjustment axis 9. The adjustment axis 9 extends parallel to the pivot axis 5. In the open position of the blade 2, the fixing clip 3 assumes a withdrawn position (FIG. 2). In the closed position of the blade, the fixing clip 3 assumes a projecting position (FIG. 5). In the open position of the blade 2, the fixing clip 3 is fully countersunk in the handle cup 4. Thus, the fixing clip 3 does not interferingly project when the knife is handled. In the closed position of the blade 2, the fixing clip 3 is in a projecting position. This makes it possible for the hand knife to be clamped or the like.

An adjusting assembly is provided to enable adjustment of the fixing clip as a function of the position of the blade 2. The adjusting assembly includes an adjusting element in the form of a pivot lever 10. The pivot lever 10 is oblong in shape and is ordinarily produced from plate metal. At one of its ends, the pivot lever 10 includes an actuating portion 11 which cooperates with the blade 2. At its opposite end, the pivot lever 10 includes an adjustable portion 12, which cooperates with the actuating clip 3.

A blade plane 18 represents the plane of symmetry of the blade 2. The actuating portion 11 is arranged on one side of the blade 2. The actuating portion 11 is concavely shaped relative to the plane 18 and forms a setting contour 13. The setting contour 13 cooperates with an actuating projection 14 of the blade 2. The actuating portion 14 laterally projects eccentrically from the blade 2 relative to the pivot axis 5 towards the actuating portion 11 and thus towards the setting contour 13. The actuating projection 14 is supported on the setting contour 13. The actuating projection 14 is in the form of a pin and is positioned in a bore 15 in the blade 2. By means of the actuating portion 11, the pivot lever 10 rests against a supporting face 17 of the hand cup 4. Thus, the pivot lever 10 is arranged between the supporting face 17 and the blade 2. The bent shape of the actuating portion, which is concave towards the blade, ensures that the pivot lever 10 is pivotable around the axis 16 relative to the handle 1 and the handle cup 4, respectively. The axis 16 extends at a right angle relative to the pivot axis 5 and parallel to the blade plane 18.

An embodiment which is convex towards the blade 2 is also conceivable wherein the supporting face 17 forms an abutment where the pivot lever is pivotable relative to the first handle cup 4. In the open position of the blade 2, the actuating projection 14 is supported on the side of the actuating portion which faces away from the setting portion 12. Thus, the pivot lever 10 assumes a position which approaches the blade plane 18. In the closed position, the actuating projection 14 is supported on the side of the actuating portion 11 which faces the setting portion 12. Thus, the pivot lever 10 assumes a position which is remote from the blade plane 18.

The setting portion 12 is connected to the guiding plate 6 of the fixing clip 3. Thus, by pivoting the pivot lever 10, the fixing clip 3 is displaced in the recess 8. The pivot lever 10 can be pivotably connected to the guiding plate 6 or have an inherent elasticity which enables angular movement of the guiding plate 6 relative to the setting portion 12.

FIGS. 7 to 10 show a second embodiment of a hand knife and will be described jointly below.

The hand knife includes a handle 101, a blade 102 as well as a fixing clip 103. The handle 101 is formed by a first handle cup 104 and a second handle cup 119, which are connected to one another. The blade 102 is connected to the handle 101 to pivot around a pivot axis 105 between an open position, shown in FIGS. 7 and 8, and a closed position shown, in FIGS. 9 and 10. In the closed position, the blade 102 is received in a receiving chamber 127, which is formed by the two hand cups 104, 119.

The fixing clip 103 includes a guiding plate 106 as well as a spring arm 107. Thus, the hand knife can be fixed to a belt or the like. The belt is clamped between the guiding plate 106 and the spring arm 107.

The guiding plate 106 is arranged in a recess 108 of the first handle cup 104 and is displaceable along an adjustment axis 109. The recess 108 passes through the first handle cup 104 and starts from the receiving chamber 127. The adjustment axis 109 is arranged at an angle relative to the pivot axis 105 and encloses an acute angle relative thereto.

Figure 10:
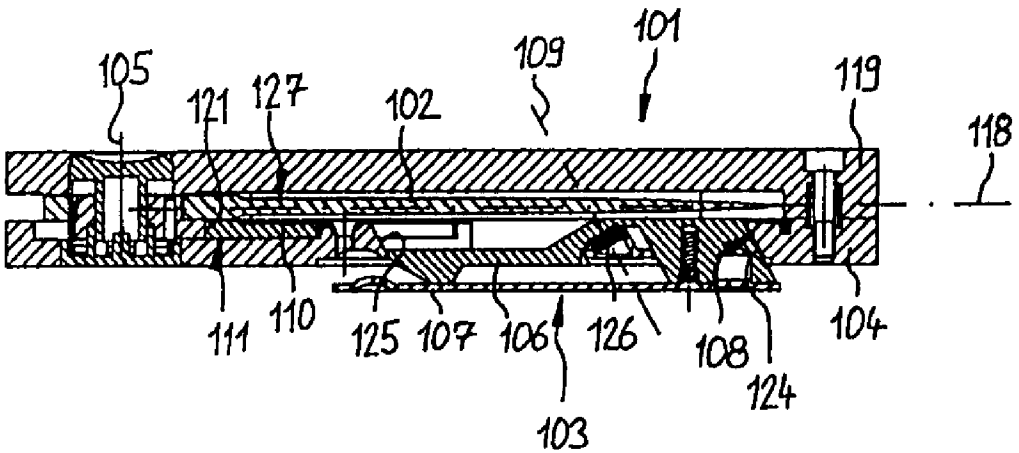
FIG. 10 is a longitudinal section view through the hand knife according to FIG. 9.

An adjusting assembly is arranged in a guiding recess 128 of the first hand cup 104, which faces the receiving chamber 127. The adjusting assembly includes an adjusting element in the form of a setting slide 110. The setting slide 110 includes an actuating portion 111, which cooperates with the blade 102, and an adjustable portion 112, which cooperates with the fixing clip 103. The blade 102 includes a setting contour 121 which extends around the pivot axis 105. The setting contour 121 is eccentrically arranged relative to the axis 105. In the present case, the setting contour 121 has a circular shape, but it can assume any other shape. Via the actuating portion 111, the setting slide 110 is supported along a setting axis 120 against the setting contour 121. The adjustable portion 112 of the setting slide 110 is supported against the guiding plate 106 of the fixing clip 103. The setting slide 110 includes guiding projections 122 which embrace the guiding plate 106 and engage guiding grooves 123 on the guiding plate 106. The guiding plate 106 is slidingly supported in the direction of the setting axis 120 against guiding faces 124, 125 of the recess 108. Thus, the actuating clip 103 is guided along the adjustment axis 109. Accordingly, the actuating clip 103, in the open position of the blade, assumes a withdrawn position (FIG. 8) and, in the closed position of the blade (102), assumes a projecting position (FIG. 10).

The actuating clip 103 is force-loaded by a pressure spring 126 to assume its withdrawn position. The pressure spring 126 is supported against the guiding plate 106 on one hand and against the first handle cup 104 on the other hand. The pressure spring 126 applies a force which extends in the direction of the adjustment axis 109 of the actuating clip 103. Thus, via the actuating clip 103, the pressure spring 126 loads the setting slide 110 against the setting contour 121 of the blade 102. In the open position of the blade 102, the setting slide 110 assumes a position which approaches the pivot axis 105. This is due to the setting contour 121, in the region of contact between the actuating portion 111 of the setting slide 110 and the setting contour 121 of the blade 102 in the open position of the blade 102, comprises the shortest distance from the pivot axis 105. In the closed position, the setting slide 110 assumes a position where the distance from the pivot axis 105 is greater, because in the region of contact between the setting slide 110 and the setting contour 121, the distance in the closed position of the blade 102 is increased. Thus, as a result of the movement of the blade 102 into the closed position, the setting slide 110 is moved away from the pivot axis 105. Thus, the guiding plate 106, due to it being guided across the guiding projections 122 and the guiding groves 123, is moved in the direction of the setting axis 120. As the adjustment axis 109 extends at an angle relative to the setting axis 120, the entire fixing clip 103 is additionally moved away from a blade plane 118 which represents the symmetry plane of the blade 102. In consequence, the fixing clip 103 reaches its projecting position as illustrated in FIG. 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hand knife comprising:

a handle;

a blade, adjustable between a closed position and an open position relative to the handle;

a fixing clip for securing the hand knife in the closed position to a user, said fixing clip adjustable between a withdrawn position wherein said fixing clip is within said handle and a projecting position relative to the handle to enable securement to the user; and an adjusting assembly adjusts the fixing clip from the projecting position into the withdrawn position when the blade is adjusted from the closed position into the open position.

2. A hand knife according to claim 1 wherein said adjusting assembly includes an adjusting element with an actuating portion and an adjustable portion, said actuating portion cooperates with the blade and said adjustable portion with the fixing clip.

3. A hand knife according to claim 1 wherein said fixing clip is displaceably guided in the handle.

4. A hand knife according to claim 2 wherein, as a result of the blade which acts on the actuating portion of the adjusting element, the adjustable portion is adjustable between a first position where the fixing clip assumes the withdrawn position and a second position where the fixing clip assumes the projecting position.

5. A hand knife according to claim 4:

wherein said blade is fixed to the handle to be pivotable around a pivot axis;

said adjusting element is provided in the form of a pivot lever which is pivotable transversely to the pivot axis between the first position and the second position; and the actuating portion includes a setting contour which cooperates with an actuating projection which eccentrically projects relative to the pivot axis from the blade; and said adjustable portion is provided at the end of the pivot lever which is remote from the actuating portion and is connected to the fixing clip.

6. A hand knife according to claim 4:

wherein said blade is fixed to the handle to be pivotable around a pivot axis;

said adjusting element is eccentrically supported relative to the pivot axis against the blade and transversely relative to the pivot axis, and by pivoting the blade, the adjustable portion is displaced transversely to the pivot axis, wherein said adjustable portion is supported against the fixing clip; and wherein said fixing clip is guided at an angle relative to the setting axis of the adjustable portion.

7. A hand knife according to claim 6:

wherein said adjusting element is in the form of a setting slide which is guided transversely to the pivot axis along a setting axis;

said blade includes a setting contour which extends eccentrically around the pivot axis and is supported against the setting slide; and the setting slide is supported against the fixing clip.

8. A hand knife according to claim 7 wherein said fixing clip is guided in the handle along an adjustment axis, and said adjustment axis encloses an acute angle relative to the setting axis of the setting slide.

9. A hand knife comprising:

a handle;

a blade, adjustable between a closed position and an open position relative to the handle;

a fixing clip for securing the hand knife in the closed position to a user, said fixing clip adjustable between a withdrawn position wherein said fixing clip is within said handle and a projecting position relative to the handle to enable securement to the user;

an adjusting assembly adjusts the fixing clip from the projecting position into the withdrawn position when the blade is adjusted from the closed position into the open position; and said adjusting assembly includes an adjusting element with an actuating portion and an adjustable portion, said actuating portion cooperates with the blade and said adjustable portion with the fixing clip.

10. A hand knife according to claim 9 wherein said fixing clip is displaceably guided in the handle.

11. A hand knife according to claim 9:

wherein said blade is fixed to the handle to be pivotable around a pivot axis;

said adjusting element is eccentrically supported relative to the pivot axis against the blade and transversely relative to the pivot axis, and by pivoting the blade, the adjustable portion is displaced transversely to the pivot axis, wherein said adjustable portion is supported against the fixing clip; and wherein said fixing clip is guided at an angle relative to the setting axis of the adjustable portion.

12. A hand knife according to claim 9 wherein, as a result of the blade which acts on the actuating portion of the adjusting element, the adjustable portion is adjustable between a first position where the fixing clip assumes the withdrawn position and a second position where the fixing clip assumes the projecting position.

13. A hand knife according to claim 12:

wherein said adjusting element is in the form of a setting slide which is guided transversely to the pivot axis along a setting axis;

said blade includes a setting contour which extends eccentrically around the pivot axis and is supported against the setting slide; and the setting slide is supported against the fixing clip.

14. A hand knife according to claim 13 wherein said fixing clip is guided in the handle along an adjustment axis, and said adjustment axis encloses an acute angle relative to the setting axis of the setting slide.

* * * * *